United States Patent [19]

Tucci

[11] Patent Number: 4,822,376

[45] Date of Patent: Apr. 18, 1989

[54] PRINTED BLEEDING MADRAS

[76] Inventor: Raymond J. Tucci, 347 Saly Rd., Yardley, Pa. 19067

[21] Appl. No.: 108,485

[22] Filed: Oct. 14, 1987

[51] Int. Cl.[4] ..... D06P 5/00

[52] U.S. Cl. ..... 8/478; 8/552

[58] Field of Search ..... 8/478, 552

[56] References Cited

U.S. PATENT DOCUMENTS 3,986,824 10/1976 Waibel et al. ..... 8/14

4,064,309 12/1977 Merger et al. ..... 428/413

*Primary Examiner*—Paul Lieberman

*Assistant Examiner*—Christine A. Skane

*Attorney, Agent, or Firm*—Reed Smith Shaw & McClay

[57] ABSTRACT

A printed bleeding madras and method for producing the same is presented wherein a pattern, preferably, in the configuration of a plaid or stripe is printed onto cloth, preferably of a uniform weave. The printed pattern is made by applying at least one print paste having less than 20% by weight of a binder. The print paste also contains various pigments which provide the permanent pattern color and various dyes which are released or flushed upon being wetted to provide the bleeding. The release of the dye is controlled by the amount of the binder.

17 Claims, No Drawings

PRINTED BLEEDING MADRAS

FIELD OF THE INVENTION

The present invention relates to a process for printing cloth and clothing to produce an effect known as "bleeding madras". More specifically the present invention relates to a printed bleeding madras and a method of producing a bleeding madras by printing.

BACKGROUND OF THE INVENTION

A madras is a light fabric, preferably cotton, with cords set at intervals or with woven check or stripe patterns, often of another color. The soft, thin fabric, typically of a light gauze-like weave, often has heavier yarns or threads in it at intervals and is used to make clothes such as shirts. The fabric is named for the Madras province in India where it originated. The madras fabrics from India were woven by hand and dyed with the extracts of various vegetable matter and other things peculiar to the Madras province of India.

Bleeding madras is a type of madras wherein the yarn has been dyed in a special way so that upon each washing, the fabric bleeds a little. By bleeding is meant that some of the dye is released from the yarn and runs, discoloring some of the surrounding fabric. The unique property of a bleeding madras is that the overall appearance of the fabric changes as the dye is released with each washing. The madras fabrics from India bleed and tint the uncolored areas and also give the fabric a very peculiar smell because of the nature of the dyes used.

Besides the smell, one disadvantage with bleeding madras from India was that the natural dyes caused skin problems for factory workers making garments from the fabric. Another disadvantage with bleeding madras from India was its slow and intermittent delivery. The supply could not keep up with the demand in the United States. Additionally, the choice of patterns was limited and the yardage available in each pattern was limited.

As a result of these disadvantages, in the mid-1960's fabric finishers introduced a domestic fabric which simulated the Indian bleeding madras in patterning, bleeding characteristics and home-spun appearance. One such domestic bleeding madras was marketed under the Del-Hi label by Cold Spring Bleachery. These domestic bleeding madrases were typically made from cotton yarn of the same size which had been dyed with special dyes which would enable it to bleed. The different colored cotton yarns were then woven to form the check, stripe or cord patterns which gave the appearance of using yarns of different thicknesses.

The disadvantage with these domestic bleeding madrases is that they are very difficult and time consuming to produce. The fabrics have to be woven in varying amounts from yarns of many different colors. This is a very time consuming and labor intensive process to ensure that the resulting patterns contain the right amount of colored yarn in the right places. Additionally, the dyeing process for the yarn to enable it to bleed is very time consuming.

It would be desirable to have a better and more efficient process for producing a bleeding madras.

SUMMARY OF THE INVENTION

Generally, the present invention provides a printed bleeding madras and a method of producing the same. Rather than actually weaving yarn of different colors or sizes together to form a madras, the present invention achieves the desired result by printing patterns of yarn of different sizes and colors onto cloth of, preferably, uniform weave. Preferably, the patterns are plaid or striped but they are not limited to these and could be many others such as floral or geometric.

The desired pattern of a madras is made by applying to a cloth such as a fabric, knit or film one or more special print pastes using standard printing processes and procedures. Preferably, at least one print paste comprises: a binder means for holding the pigment paste together and to the fibers of the cloth; a dye means for bleeding; a of pigment means for producing the pattern; and a viscosity agent which enables the print paste to be easily applied to the cloth during printing. The binder means comprises less than 20% by weight, and preferably between 4% and 16% by weight, of the print paste. Various dye means can be used to produce the bleeding effect such as direct dye, acid dye, vat dye, dispersed dye, fiber reactive dye or others. Preferably, a water soluble dye is used such as a direct dye, however, any dye can be used which will bleed or can be made to run.

The bleeding or release of the dye means is dependent upon the amount of binder present. More binder results in less bleeding while less binder results in more bleeding. Various combinations of dye means and pigment means can be used to obtain the desired color combination. Similarly, one print paste having one color may be used for part of a pattern while another print paste having a different color may be used for another part of the pattern. The present invention is not limited by the various combinations of pigment means and dye means. Each print paste could have within it pigment means to give one color and dye means which would bleed in the same color or, alternatively, bleed in a different color.

To produce a printed bleeding madras, a piece of cloth, preferably cotton and of a uniform weave is printed using standard printing techniques with a madras pattern using a plurality of variously colored print pastes according to the present invention. The printed cloth is cured and then subjected to a wetting process which causes the direct dye to run or bleed. The amount of bleeding depends in part on the number of wettings, the amount of direct dye and the amount of binder. Thereafter, the cloth can be treated with resin or any other colorfasting agent to make the pigment and direct dye colorfast or it can be finished plain as is, which would permit additional bleeding and wash-down.

Additionally, various scents and chemicals can be incorporated into the print paste to have a variety of desired effects. For example, a non-water soluble scent such as a perfume, preferably having a high volatility, could be included in the print paste to obtain a pleasing smell which is time released with the bleeding. Similarly other non-water soluble chemicals with desired properties such as insect repellant could also be included in the print paste for slow release over time.

Other details, objects and advantages of the present invention will become apparent as the following description of the presently preferred embodiments and presently preferred methods of practicing the invention proceeds.

DETAILED DESCRIPTION OF THE INVENTION

The present invention of a printed bleeding madras can be used with a variety of cloths such as wovens, knits or films; a variety of materials such as cottons, polyesters, or nylons; and a variety of weights such as from 0.5 yds./lb. to 9.0 yds./lb. Some fabrics which have been used successfully to make a printed bleeding madras are: (1) a 50% cotton and 50% polyester blend in a 78×54 weave; (2) a 100% cotton bull denim having a weight of 13 oz./yd.; (3) a 100% cotton canvas having a weight of 10 oz./yd.; (4) a 100% cotton in a 60×60 weave, having a weight of 1.95 yds./lb.; and (5) a 100% cotton in a 68×68 weave, having a weight of 2.35 yds./lb.

Preferably the cloth upon which the printing is to be done is cotton and is woven from uniform strands of thread or yarn, unlike a madras from India which typically uses yarn of different sizes in the fabric itself. The madras in the present invention is obtained by printing the different sizes and colors of the thread or yarn pattern on the cloth after it has been woven or knitted. Lines of different shapes, sizes, configurations and colors are printed on the fabric to obtain a pattern which gives the appearance of a madras. By incorporating into the printed patterns, certain pigments, dyes and binders, in the proper amounts, a printed bleeding madras can be produced which looks and bleeds like a bleeding madras from India.

Preferably, the fabric is prepared for printing in the usual manner. For example, the fabric can be desized, boiled off and bleached white or desized and scoured with no bleach. Various print pastes are made according to the present invention to obtain the colors necessary for the pattern to be printed. Preferably, the fabric is printed using screens for each color. Print pastes of the present invention do not have to be used for all colors of the pattern but only for those colors which bleed.

Preferably, the print paste comprises at least one non-water soluble pigment means such as Blue 3G, Violet 4B, Black or Red 2BR, at least one water soluble dye means such as Direct Blue RL made by Pfister, a binder means such as resin, Binder LC or acrylic which is less than 20% by weight of the print paste and a viscosity agent. Preferably, 4% to 16% of the print paste by weight is binder means.

Different bleeding effects will result depending on the amount of binder means and dye means. The less binder means the more bleeding. For example, 1 gallon of binder means per 25 gallons of print paste results in a lot of bleeding and a light shade, 2 gallons of binder means per 25 gallons of print paste results in moderate bleeding and a medium shade, while 3 gallons of binder means per 25 gallons of print paste results in very little bleeding and a dark shade. There is a tremendous amount of wash-down and bleeding of a dark shade if only 4% of the print paste is binder means. Similarly, no wash-down or bleeding on a dark shade occurs if 20% of the print paste is binder means. In a preferred embodiment, less binder is used when the pigment means is subjected to a wash-down process. Wash-down is the wearing away or "washing-down" of the non-water soluble pigment means which forms the colors of the printed pattern. Faded clothing is the result of wash-down.

Preferably, the dye means is a water soluble dye such as Direct Blue RL. This direct dye is added to a mixture of the pigment means and the binder means. The required amount of a viscosity agent, such as Water Clear, is then added to the print paste mixture to obtain the proper viscosity for printing. The color of the print paste is determined by the color of the pigment means therein. The dye means, however, produces the bleeding effect and can be of the same color or a different color than the pigment means. For example, a red dye means could be included in a print paste which has a pigment means which colors the fabric blue when printed. Although this results in a blue stripe on the fabric, the stripe bleeds red because of the red dye means.

When a fabric printed with the print paste described above is subjected to a mist, spray or a dip in an aqueous or solvent solution, wicking or flushing occurs and the fabric is said to bleed. A catalyst or other agent such as salt can be added to the aqueous solution to accelerate or assist in the bleeding and the coloring of the surrounding fabric. Subsequent bleeding, but to a lesser degree, will occur when the fabric is heated and subjected to bending, twisting, pulling, kneading or other movements which disturb the bonding of the pigment means to the fabric fibers. These movements can occur during normal washing.

Since, preferably, the pigment means is not water soluble, it will wash-down and flush away while the dye means, which preferably is water soluble, will bleed and thereby color the surrounding fabric fibers since the dye means has an affinity for them. Since the print paste does not contain enough binder to make the pigment means colorfast, the pigment means will also wash-down and be removed over time giving an aged or worn look such as found in faded jeans. This will occur while the dye means continues to bleed. Since the pigment means is non-water soluble, it will not stain the rest of the fabric during wash-down but will simply wash away.

Preferably the binder means is a resin such as acrylic which holds the dye means and the pigment means together and to the fabric fibers. The binder means is disturbed by heat and agitation of the fabric such as by the bending, twisting, etc. of the fabric fibers during washing. The action of the binder can be described as windowpaning since the binder means behaves much like the soap film on a window screen. The binder means holds the pigment means to the fabric fibers much like the soap film on a window screen. As one bends a window screen, however, the soap film thereon breaks, exposing whatever is underneath. In a similar way, the bending and twisting of the fabric breaks the windowpaning of the binder means and exposes the pigment means and the dye means. Water is then able to reach the exposed dye means causing it to bleed and reach the pigment means causing it to wash-down.

Once a fabric has been printed with one or more print pastes of the present invention, it is preferably dried and cured at 325° F. The fabric can then be subjected to various finishing processes. One such finishing process causes the fabric to bleed. The fabric is dipped in a softener and detergent mix at room temperature to wet it; squeezed with three tons of pressure on a 2 roll rubber padder at a speed of 35 yards per minute to remove excess moisture; and run over six teflon coated heated cylinders called cans where sizzling takes place and the direct dye means starts to bleed. When the wet-out fabric hits the hot cans, the moisture in the fabric turns to steam which causes the movement of the direct dye means or bleeding. While still damp, the fabric can be placed on a clip or pin frame where complete drying will take place. Thereafter the fabric is sent to a sanforizer for shrinkage control and to other finishing stations for additional finishing such as colorfasting if no more bleeding is to occur.

The following are two examples of print pastes according to the present invention which have been used experimentally to make a printed bleeding madras.

EXAMPLE 1

A navy blue shade for a printed pattern which would bleed blue was made by using a print paste according to the following formula. Approximately 50 gallons of print paste were made. Pigment means in the amount of 26 lbs. of Blue 3G, 6 lbs. of Violet 4B and 2 lbs. of Black were combined with 4 lbs. of dye means Direct Blue RL and mixed with 4 gallons of binder means Binder LC and 40 gallons of viscosity agent Water Clear. The print paste was successfully printed on various fabrics in a striped pattern and the navy blue stripes bled blue as expected when sizzled in the finishing process.

EXAMPLE 2

A burgundy shade for a printed pattern which would bleed blue was made by using a print paste according to the following formula. Approximately 36 gallons of print paste were made. 26 lbs. of pigment means Red 2BR was combined with 0.8 lbs. of dye means Direct Blue RL and mixed with 3 gallons of binder means Binder LC and 30 gallons of viscosity agent Water Clear. The print paste was successfully printed on various fabrics in a striped pattern and the burgundy stripes bled blue as expected when sizzled in the finishing process.

While a presently preferred embodiment of practicing the invention has been described with particularity, the invention may be otherwise embodied within the scope of the following claims.

What is claimed is:

1. A printed bleeding madras effect made using a print paste comprising: a non-water soluble pigment for producing a printed color pattern on a piece of fabric; a dye for bleeding which thereby colors a portion of the fabric not forming part of the printed pattern; a binder for holding the print paste to the fabric wherein the binder comprises from about 4% to less than 20% of the print paste by weight; and a viscosity agent for thickening the print paste; the dye, the pigment, the binder and the viscosity agent adapted for use on the fabric.

2. The printed bleeding madras as described in claim 1 wherein the binder comprises between 4% and 16% of the print paste by Weight.

3. The printed bleeding madras as described in claim 1 wherein the dye is water soluble.

4. The printed bleeding madras as described in claim 1 wherein the color of the dye is similar to the color of the pigment.

5. The printed bleeding madras as described in claim 1 wherein the color of the dye is different from the color of the pigment.

6. The printed bleeding madras as described in claim 1 wherein the print paste also comprises a non-water soluble scent.

7. The printed bleeding madras as described in claim 1 wherein the print paste also comprises a non-water soluble chemical.

8. A printed bleeding madras effect made using plurality of print pastes printed on a cloth in a printed color pattern wherein at least one print paste comprises: at least one dye for bleeding which thereby colors a portion of the cloth not forming part of the printed pattern; at least one on-water soluble pigment for producing the printed pattern; a binder or holding the print paste together and to the cloth wherein the binder comprises from about 4% to less than 20% of the print paste by weight; and a viscosity agent for thickening the print paste; the dye, the pigment, the binder and the viscosity agent adapted for use with the cloth.

9. The printed bleeding madras as described in claim 8 wherein the binder comprises between 4% and 16% of the print paste by weight.

10. The printed bleeding madras as described in claim 8 wherein the dye is water soluble.

11. The printed bleeding madras as described in claim 8 wherein the print paste also comprises a non-water water soluble scent.

12. The printed bleeding madras as described in claim 8 wherein the print paste also comprises a non-water soluble chemical.

13. A process for making a bleeding madras effect comprising the steps of:

a. printing a fabric with at least one print paste to form a printed color pattern, the print paste comprising a non-water soluble pigment for producing the printed color pattern on the fabric, a dye for bleeding on the fabric thereby coloring a portion of the fabric not forming part of the printed pattern, a binder for holding the dye and pigment to the fabric, the binder comprising from about 4% to less than about 20% of the print paste by weight, and a viscosity agent for thickening the print paste, the dye, the pigment, the binder and the viscosity agent adapted for use on the fabric;

b. curing the printed pattern on the fabric; and c. bleeding the printed pattern on the fabric by wetting the fabric with a liquid thereby causing the dye means to bleed and color a portion of the fabric not forming part of the printed pattern.

14. The process as described in claim 13 further comprising the step of finishing the cloth.

15. The process as described in claim 14 wherein the step of finishing comprises inducing some bleeding.

16. The process as described in claim 15 further comprising the step of color-fasting the cloth after some bleeding has occurred.

17. The process as described in claim 16 wherein the step of finishing further comprises sanforizing the cloth.

* * * * *